US007909896B2

(12) United States Patent
Bennett

(10) Patent No.: US 7,909,896 B2
(45) Date of Patent: Mar. 22, 2011

(54) PROCESS FOR PRODUCTION OF LOW TEMPERATURE CHAR DURING PRODUCTION OF LOW TEMPERATURE TARS

(75) Inventor: Harold L. Bennett, Albuquerque, NM (US)

(73) Assignee: Bennett Engineers and Associates of Austin Colorado, Austin, CO (US)

( * ) Notice: Subject to any disclaimer, the term of this patent is extended or adjusted under 35 U.S.C. 154(b) by 94 days.

(21) Appl. No.: 09/994,560

(22) Filed: Nov. 27, 2001

(65) Prior Publication Data

US 2003/0097784 A1 May 29, 2003

(51) Int. Cl.
*C10L 5/02* (2006.01)

(52) U.S. Cl. ..... 44/591; 44/592; 44/607; 44/608; 44/620; 44/628; 44/629

(58) Field of Classification Search ..... 44/591, 44/592, 607, 608, 628, 620, 630
See application file for complete search history.

(56) References Cited

U.S. PATENT DOCUMENTS 3,576,734 A 4/1971 Bennett
4,273,643 A * 6/1981 Bennett ..... 208/8 R
4,935,036 A * 6/1990 Ikura ..... 44/620

* cited by examiner

*Primary Examiner* — Cephia D Toomer
(74) *Attorney, Agent, or Firm* — Woodard Emhardt Moriarty McNett & Henry LLP

(57) ABSTRACT

An improved process for the production of smokeless (low $CO_2$—CO emitting) boiler fuels which have been obtained by careful temperature control and the addition of waste, trash or other carbonaceous material during carbonization of various coal materials such as tar sands, bituminous coal, peat lignite, and oil shale.

12 Claims, 6 Drawing Sheets

PROCESS FOR PRODUCTION OF LOW TEMPERATURE CHAR DURING PRODUCTION OF LOW TEMPERATURE TARS

TECHNICAL FIELD OF THE INVENTION

The present invention relates generally to fuel production and, more particularly, to a low $CO_2$—CO emission process for the production of boiler fuels from coal precursors and with carbonaceous materials additives.

BACKGROUND OF THE INVENTION

Char or semi-coke products are becoming increasingly important as alternatives to coal in the fuel market. Solid fuel users currently grind coal into fine powders to maximize the efficiency of its consumption. While grinding improves coal-burning efficiency and reduces emissions, grinding coal is an expensive process. Coke alternatives are likewise desired in fine sizes. Therefore, as coal alternatives, light cokes are desired having reduced size and strength (i.e., easier to grind) as compared to cokes produced from fixed retorts.

One problem associated with burning coal or coke is the associated emission of airborne pollutants or smoke. Not only is the evolution of smoke into the environment undesirable from a pollution standpoint, but smoke also represents inefficiently combusted carbonaceous fuel materials. Heavy carbonaceous molecules in smoke not only represent potential health and environmental hazards, but also the potential for further energy acquisition through more efficient combustion. There is therefore a need for more efficiently burning solid carbonaceous fuel materials that burn with reduced gaseous emissions. The present invention addresses this need.

SUMMARY OF THE INVENTION

The present invention relates to an improved process for the economical production of smokeless boiler fuel (char) and synthetic crude oil. The synthetic crude oil is obtained from hydrogenated low temperature tar, which has been prepared by carefully controlling the temperature during the carbonization of various carboniferous materials such as bituminous coal, peat, lignite, or tar sands.

In general, the "smokeless char" is produced through the low temperature carbonization of coal, preferably through a substantially anaerobic heat treatment of coal at temperatures at the various levels of between about 300° and 700° C. By maintaining the temperature low enough to prevent the decomposition of the primary tar, a high yield of liquid carboniferous products is obtained for the production of a satisfactory "smokeless fuel".

The heat transfer quality to the coke is improved during carbonization by using thin layer and/or mechanical agitation of the coal charge. The practice of production and utilization of caking or semi-caking coke is undesirable for these purposes. When using this improved process for various coals and carbonaceous materials, the furnace charge will be adjusted or blended to a lower agglomeration value by dilution with organic matter (peat, lignite, waste and trash tires) or with coals having appreciable amounts of fusible or other organic matter. Such blends will raise the percentage of volatiles in a mixture to change the classification to outside the range of agglomeration or caking. Tar gas fractions are removed from the roaster cells through injected steam treatment of the heated solids.

Following removal of the tar and producer gas fractions (smoke), the tar gas fractions are washed, filtered and fractionally cooled into primary tars and various gasses. The primary tars are treated and pressurized with hydrogen and converted to synthetic crude oil using methods known to those of ordinary skill in the art (See, for example, U.S. Pat. No. 3,576,734 to Harold L. Bennett, incorporated herein by reference.) All water containing soluble material, such as phenols, resulting from the various processes and conditions is recirculated through the roaster steam stream.

DESCRIPTION OF THE PREFERRED EMBODIMENT

Figure 1A:
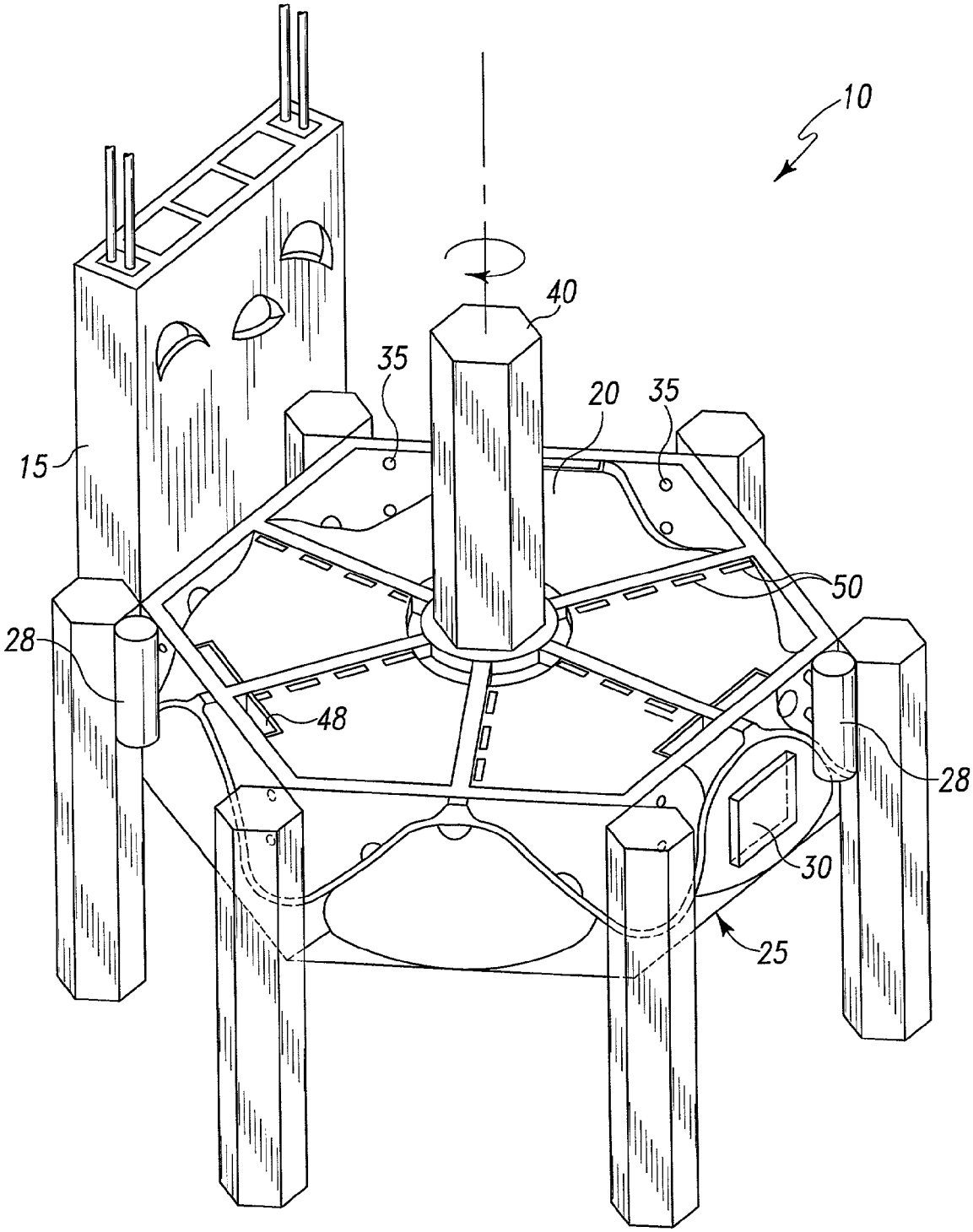
FIG. 1A is a partial sectional perspective view of a portion of a roaster used with a first embodiment char production system of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1B:
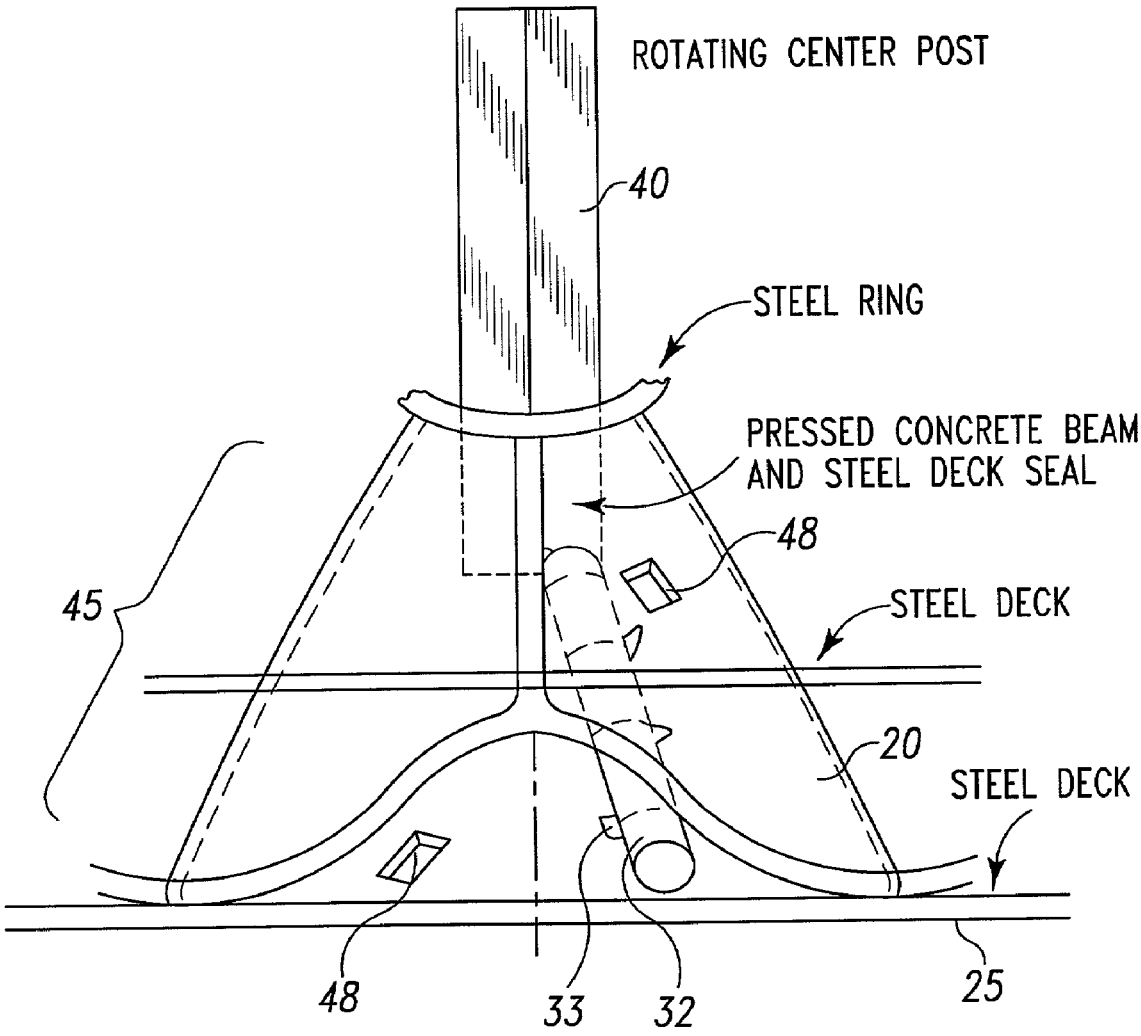
FIG. 1B is an enlarged partial sectional perspective view of the roaster of FIG. 1A.
Figure 1C:
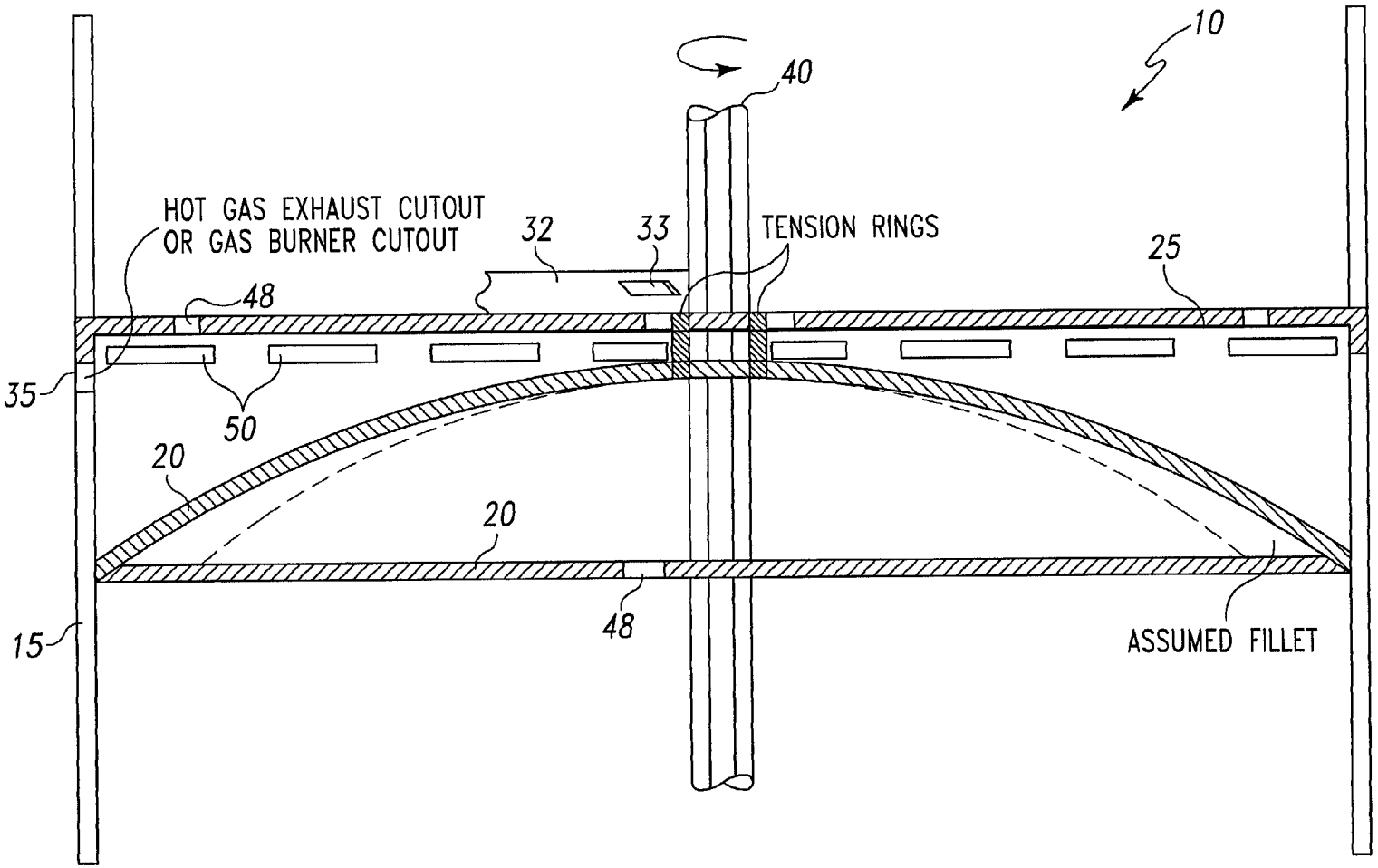
FIG. 1C is a sectional elevational view of the roaster of FIG. 1A.

In the practice of the present invention, a carbonaceous precursor material, such as bituminous coal with up to 20% blending materials (such as peat, lignite, animal excrement, animal and vegetable products, waste food, paper and dry trash (i.e., waste paper, cardboard, office refuse, shredded rubber from discarded tires and the like)) and the like is introduced into a suitable roaster 10, such a multi-hearth vertical roaster (see FIGS. 1A-1C), into a thermally and chemically controlled environment. The blending material is preferably an organic matter, the addition of which acts to lower the agglomeration value of the carbonaceous material. Agglomeration and/or caking of the resulting carbonaceous mix may be prevented or remedied through the increased addition of volatiles in the carbonaceous precursor material.

The carbonaceous precursor material (or the carbonaceous mix including the blending material) may be introduced at any hearth level, but is preferably introduced into the top of the roaster 10. The preferred multi-hearth roaster 10 preferably has the ability to move a thin layer of material (6-12 inches deep), such as with rotating arms as is commonly done to process such materials as uranium ores and pyrites. The temperature range for the low-temperature carbonization process (from about 300° to about 700° C.) is well within the cherry-red operating range of several non-corroding steel alloys. The environment of the carbonization process is preferably substantially oxygen-free or anaerobic.

The load-bearing outer walls 15 of the roaster 10 are preferably formed from reinforced prestressed concrete. Each hearth or level of the roaster includes a relatively thin, substantially parabolic shell of (preferably reinforced prestressed) concrete covering a substantially flat deck or floor 25. The decks 25 are preferably constructed of Corten steel or some other like corrosion resistant metal (such as, for example, chromium steel or the like) having relatively high heat transfer characteristics. The ceiling shell 20 of each level is preferably a thin shell of reinforced prestressed concrete 20 (1½-3 inches thick), more preferably with a hyperbolic section to facilitate the quick collection of the tar gases and to direct the gas-fired heat to the deck 25 above. Gas jets 28 are positioned to fire the envelope defined between the top of ceiling shell 20 and the bottom of the deck 25 above, heating the deck 25 from below. In other words, the double wall construction provides indirect heat surfaces to the thin coal layer via the steel deck 25 as the roaster charge (i.e., the coal) is being agitated and stirred.

Figure 2:
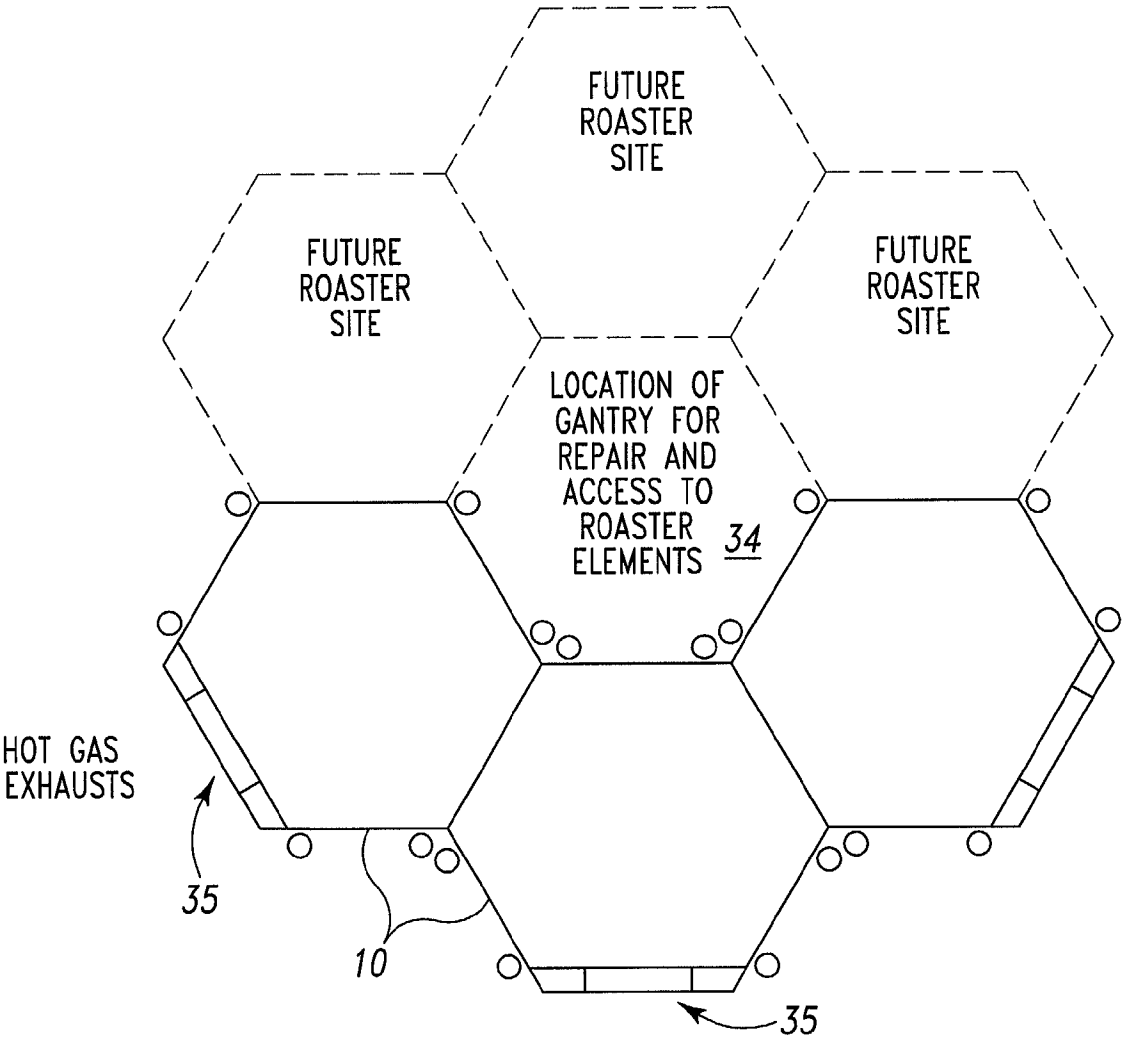
FIG. 2 is a schematic view of several interconnected roasters of the type illustrated in FIG. 1A.

The outside walls 15 preferably include ports 30 to provide easy access for the repair or replacement of the inner workings of the roaster 10. The roaster 10 includes rotatable arms 32 with attached harrow scrapers 33 for urging the roaster charge through the roaster 10. The rotatable arms 32 are preferably attached to a central rotatable column 40 for easy repair, such as with ⅛ turn quick connections or the like. The rotatable arms 32 extend from the central column 40 parallel to the deck 25 and are moved through the roaster 10 to agitate any charge material therein. The rotatable arms 32 can thus be accessed through the ports 30 to be replaced quickly, such as with a grappler with a rotating head. The access and repair equipment (not shown) is preferably installed in a centrally located gantry 34, and is more preferably capable of remote control. The repair equipment is preferably adapted to maintain the roaster's substantially oxygen free atmosphere during repairs. Preferably, a number of roasters 10 are arranged around a central gantry 34, as illustrated in FIG. 2.

The tars gases evolved during the low-temperature carbonization process are collected at each level and removed to a cooling fractionation tower via insulated ducts 35 in the steam flow. The gasses are passed through a filter to a fractionation condenser where the producer gasses and water are removed, leaving the low temperature tars. The remaining tars are then treated with hydrogen gas under pressure and are converted to synthetic crude oil and producer gas. The producer gasses transported to a standard light ends plant for further treatment.

The tar gases thus removed are filtered and/or water washed to remove coal and ash particles. The tar gases are preferably at least partially cooled prior to mixing with tar gases from other levels to prevent unintended decomposition of the tar gas by hot gasses from the lower levels. Steam may be added to facilitate quick gas removal and to help prevent decomposition and to maintain positive pressure.

The tar gasses are removed from each level of the roaster 10 at the approximate temperature of that level. Live steam is used as the tar gas removal vehicle. The steam and tar gasses are cooled upon removal to prevent decomposition of the tar gasses into methane and producer gasses.

The coal and solid waste material is preferably dropped and/or fed from a coal feed at the top level of the roaster 10, preferably at or near the center post 40. The coal particles (which may be lump, nut or the like) are distributed by the innermost positioned harrow scraper 33, which is preferably positioned to urge the coal particles away from the center post 40 with a plowing action as the arm 32 is rotated across the deck 25. The scraper 33 on the next arm 32 will be offset to urge the coal particles relative to the center post 40 outwardly through the hot zone 45 of the roaster 10 until the heated particles are near the outside wall of the roaster 10. The heated particles are then transferred (dropped) through a window or cutout 48 in the deck 25 and slots 50 in the shell 20 to the next lower level. The harrow scrapers 33 on the next lower level are preferably positioned to urge the coal particles back towards the center post 40. The heated particles are then migrated toward the center post 40 of the roaster 10 while being further heated, with tar gas being simultaneously removed.

Figure 3:
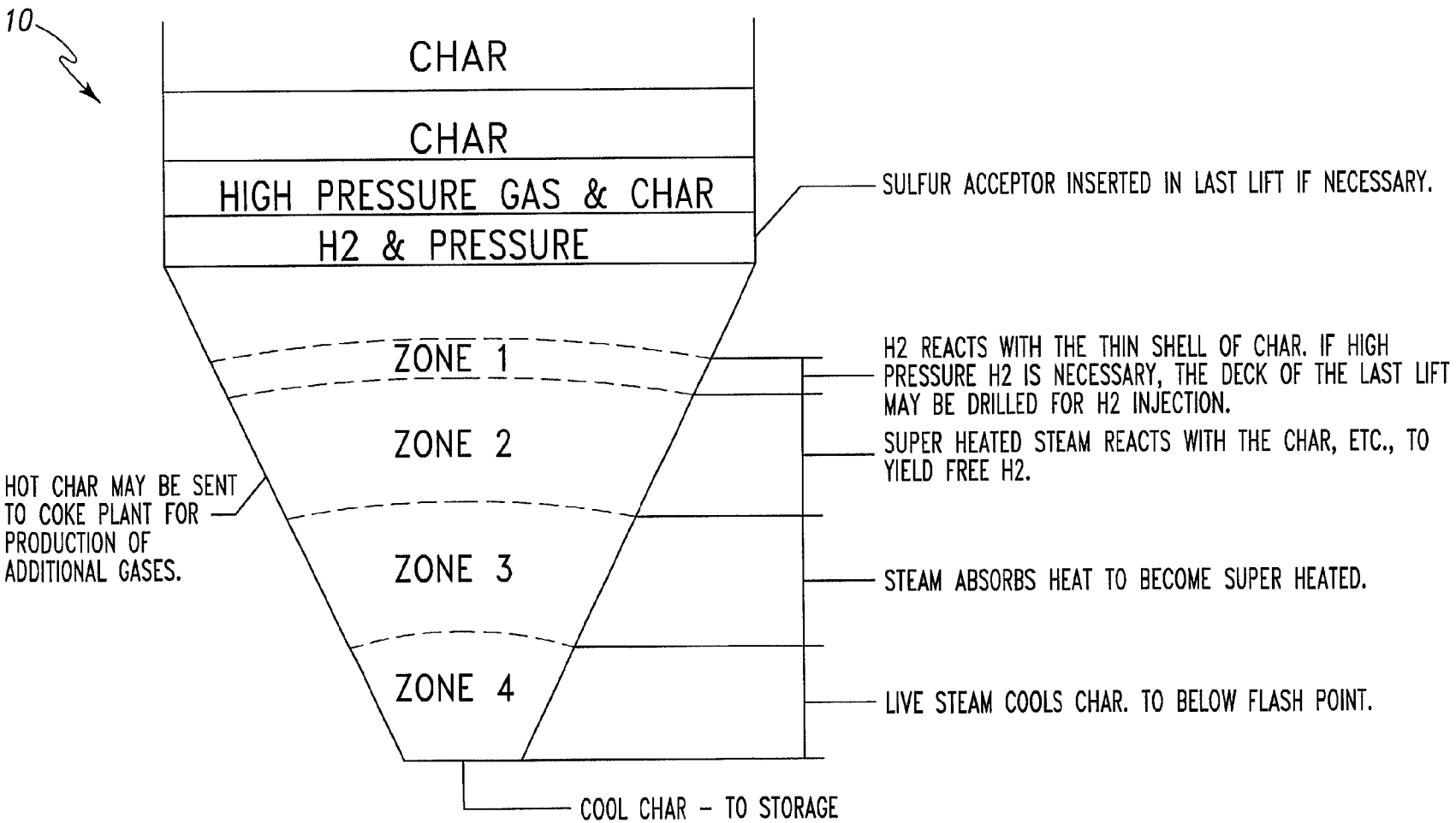
FIG. 3 is a schematic view of the characteristics of the various levels of a roaster of the type illustrated in FIG. 1A.
Figure 4:
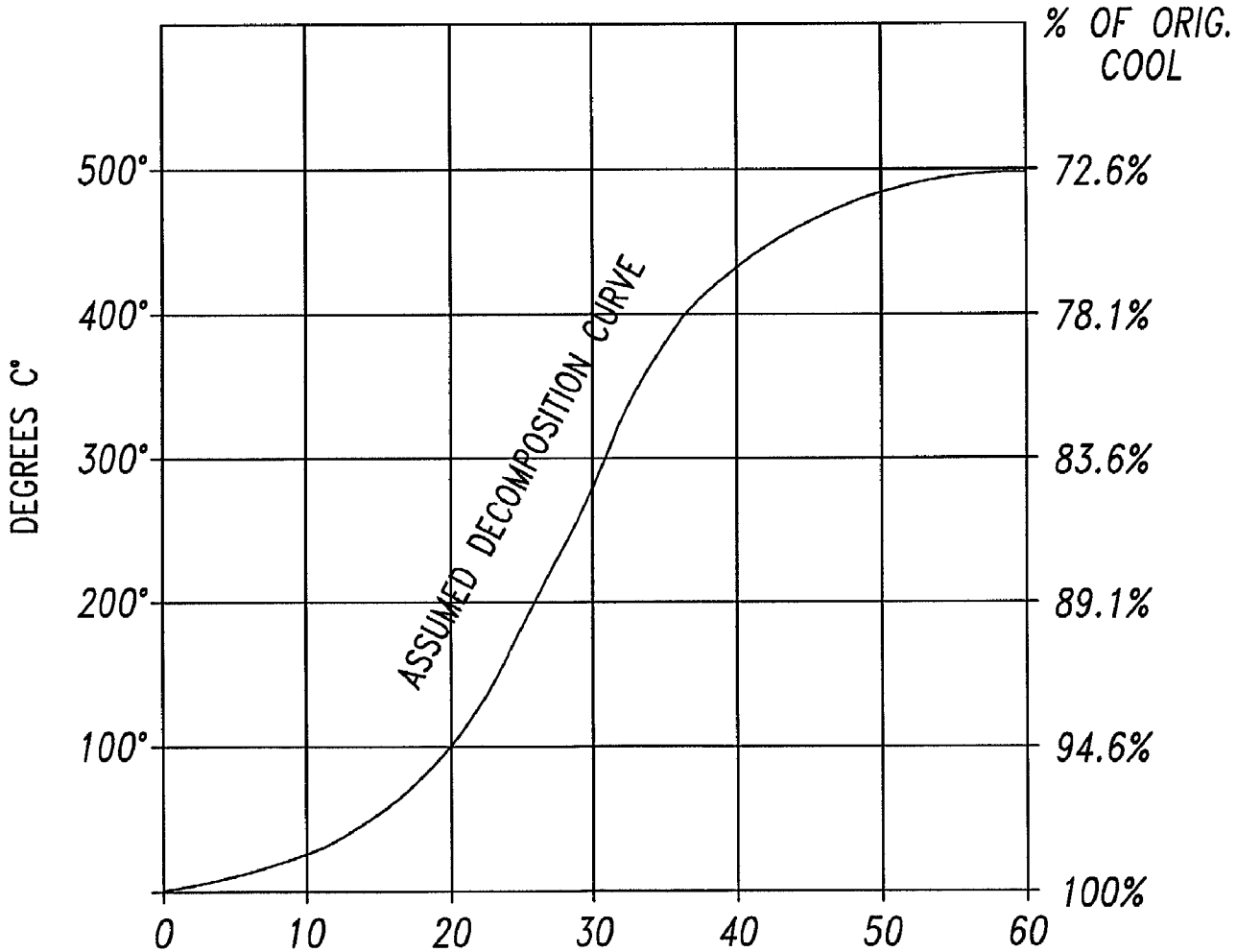
FIG. 4 is a plot of roasting time vs. roasting temperature for a typical char fired in the embodiment of FIG. 1A.

Upon nearing the center of a given level, the forming char material particles are transferred to the next lower level, and the agitation process is repeated until the char material particles complete their travels through the roaster 10. The functional relationship between the various levels of the roaster 10 is graphically illustrated in FIG. 3. The moving and stirring of the char materials is preferably continuous. By adjusting the speed of the harrow arms 32 and the depth of the bed, the low-temperature carbonization retention time can be adjusted (preferably up to about 3 hours). Pressurized steam may be added at each level as desirable to assist in the removal of the tar gases as well as to prevent upward movement of the lower level gasses, contact with which would tend to decompose the cooler gasses in the upper level cells. The processing of the resultant char is complete when a predetermined, desirable amount of tar gas is collected per unit amount of coal processed. The retention time for a specific coal will depend upon such factors as the coal's characteristics, the type of heat, the depth of bed used, and the like. The relationship between roasting time and roasting temperature is graphically illustrated in FIG. 4. Typically, total coal retention time in the roaster is about 2½ hours. Depending on the type of coal used, the type of sulfur involved, and other like factors, lime, limestone or some other carbonate acceptor material may be added to the later agitating levels to provide adequate mixing with the char. The various levels of the multi-hearth roaster 10 may be heated by any convenient means, such as direct-fire gas, electric heating elements, some combination of the two, or the like. The heat so produced is directed between the reinforced hyperbolic concrete arches 20 and the steel decks 25 from the outside wall 15 of the roaster 10. The heat generated to heat the cells is collected in insulated flues for further distribution and utilization in the system.

The resultant fine particulate hot char (i.e., the "smokeless fuel") is deposited from the roaster 10 into an inverted cone-shaped bin (not shown) where it is cooled; steam (or superheated steam) may be added to facilitate cooling and/or sulfur removal. Hydrogen and sulfur dioxide thus derived are removed for other use in the system. A heat exchanger is preferably included as part of the hopper design. The particulate nature of the char results in a high surface area-to-volume ratio, resulting in a highly combustible powder well suited as a fuel. Care must be taken to cool the char below its flash point before exposing the char to a substantially oxygenated environment to reduce the risk of premature combustion of the char. Preferably, the char is cooled to below 250° C. before removal from the roaster 10 and is more preferably maintained in an anaerobic environment.

Additional roasting may be employed to produce coke and additional $H_2$ gas. This can be accomplished with a continuous process or a batching unit in a traditional coke-producing manner. The hydrogen gas is used to convert the tar to synthetic crude oil and in various light-end plant functions known to one of ordinary skill in the art, such as clause sulfur removal, fertilizer production, and the like.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are to be desired to be protected.

What is claimed is:

1. A method for preparing carbon-derived char comprising the steps of:

(a) providing a carbonaceous precursor material;

(b) lowering the agglomeration value of the carbonaceous precursor material through the addition of inert organic matter;

(c) raising the percentage of volatiles in the carbonaceous precursor material to prevent agglomeration and caking;

(d) roasting the carbonaceous precursor material for between about 2 hours and about 4 hours in a multi-hearth roaster including a plurality of decks constructed of non-corrosive metal with high-heat transfer characteristics, with the ability to move a thin layer of material with rotating arms equipped with plow-shaped protrusions, in a substantially anaerobic environment at a roasting temperature between about 300 and 700 degrees Celsius;

(e) cooling the resultant solid char;

(f) after step (d) and before step (e) extracting tar gases;

(g) before step (e) filtering the tar gases; and (h) before step (e) washing the tar gases.

2. The method of claim 1 wherein each deck includes floor supports and ceilings formed from thin-shelled reinforced concrete double-wall construction.

3. The method of claim 2 wherein the roaster further includes a number of outside walls and wherein each outside wall has at least one port adapted to provide anaerobic access to the roaster.

4. The method of claim 1 wherein step (f) includes the use of injected steam to assist in the removal of the tar and producer gases.

5. The method of claim 1 further comprising the step of after step (a) and before step (d) adding a carbonate acceptor material to facilitate sulfur removal.

6. The method of claim 1 wherein step (e) further includes depositing the resultant solid char in an inverted cone-shaped bin and injecting steam thereinto.

7. A low-emission solid carbonaceous fuel produced by the following process steps:

a) providing a carbonaceous precursor material;

b) lowering the agglomeration value of the carbonaceous precursor material through the addition of inert organic matter;

c) raising the percentage of volatiles in the carbonaceous precursor material to prevent agglomeration and caking;

d) roasting the carbonaceous precursor material for between about 2 hours and about 4 hours in a multi-hearth roaster including a plurality of decks constructed of non-corrosive metal with high-heat transfer characteristics, with the ability to move a thin layer of material with rotating arms equipped with plow-shaped protrusions, in a substantially anaerobic environment at a roasting temperature between about 300 and 700 degrees Celsius;

e) cooling the resultant solid char;

f) after step (d) and before step (e), extracting tar gases;

before step (e), filtering the tar gases; and h) before step (e) washing the tar gases.

8. The fuel of claim 7 wherein each deck includes floor supports and ceilings formed from thin-shelled reinforced concrete double-wall construction.

9. The fuel of claim 8 wherein the roaster further includes a number of outside walls and wherein each outside wall has at least one port adapted to provide anaerobic access to the roaster.

10. The fuel of claim 7 wherein step (f) includes the use of injected steam to assist in the removal of the tar gases.

11. The fuel of claim 7 further comprising the step of after step (a) and before step (d) adding a carbonate acceptor material to facilitate sulfur removal.

12. The fuel of claim 7 wherein step (e) further includes depositing the resultant solid char in an inverted cone-shaped bin and injecting steam thereinto.

* * * * *

UNITED STATES PATENT AND TRADEMARK OFFICE

CERTIFICATE OF CORRECTION

PATENT NO. : 7,909,896 B2
APPLICATION NO. : 09/994560
DATED : March 22, 2011
INVENTOR(S) : Harold L. Bennett It is certified that error appears in the above-identified patent and that said Letters Patent is hereby corrected as shown below:

In Claim 7, column 6, line 23, please change "before step (e), filtering the tar gases; and" to --g) before step (e), filtering the tar gases; and--

Signed and Sealed this
Tenth Day of May, 2011

David J. Kappos
*Director of the United States Patent and Trademark Office*